US009475503B2

(12) United States Patent
Fessler et al.

(10) Patent No.: US 9,475,503 B2
(45) Date of Patent: Oct. 25, 2016

(54) CABLEWAY SYSTEM FOR TRANSPORTING PERSONS OR GOODS

(71) Applicant: INNOVA PATENT GMBH, Wolfurt (AT)

(72) Inventors: Dietmar Fessler, Langen bei Bregenz (AT); Peter Luger, Dornbirn (AT)

(73) Assignee: Innova Patent GmbH, Wolfurt (AT)

( * ) Notice: Subject to any disclaimer, the term of this patent is extended or adjusted under 35 U.S.C. 154(b) by 260 days.

(21) Appl. No.: 14/317,439

(22) Filed: Jun. 27, 2014

(65) Prior Publication Data

US 2015/0083016 A1 Mar. 26, 2015

(30) Foreign Application Priority Data

Sep. 26, 2013 (AT) ..... 745/2013

(51) Int. Cl.
*B61B 7/02* (2006.01)
*B61B 12/02* (2006.01)

(52) U.S. Cl.
CPC ..... *B61B 7/02* (2013.01); *B61B 12/02* (2013.01); *B61B 12/026* (2013.01)

(58) Field of Classification Search
CPC ..... B61B 7/02; B61B 12/02; B61B 12/04; B61B 12/026
USPC ..... 104/112, 173.1, 173.2, 189
See application file for complete search history.

(56) References Cited

U.S. PATENT DOCUMENTS 4,608,930 A * 9/1986 Galmiche ..... B61B 12/127 104/180
4,957,047 A * 9/1990 Feuz ..... B61B 7/02 104/112
2002/0088368 A1* 7/2002 Pabst ..... B61B 12/02 104/87
2002/0134276 A1* 9/2002 Pabst ..... B61B 12/125 104/87
2007/0169660 A1* 7/2007 Pabst ..... B61B 12/04 104/196
2009/0151594 A1* 6/2009 Dur ..... B61B 12/026 104/112
2013/0319280 A1* 12/2013 Wieser ..... B61B 7/02 104/112

* cited by examiner

*Primary Examiner* — Zachary Kuhfuss
(74) *Attorney, Agent, or Firm* — Laurence A. Greenberg; Werner H. Stemer; Ralph E. Locher

(57) ABSTRACT

A cableway system for the transport of persons or goods has two pairs of track cables, which extend between two terminal stations, such as a valley station and a mountain station. Transport vehicles, such as gondolas, are moved along the track cables by at least one traction cable. The track cables run in a curved path in the region of at least one tower and the traction cable is guided in the region of the at least one tower via carrying rollers. At least some of the carrying rollers for the traction cable, which are located in the region of the at least one tower, are adjustable in terms of their position in relation to the two track cables.

17 Claims, 10 Drawing Sheets

CABLEWAY SYSTEM FOR TRANSPORTING PERSONS OR GOODS

CROSS-REFERENCE TO RELATED APPLICATION

This application claims the priority, under 35 U.S.C. §119, of Austrian patent application A 745/2013, filed Sep. 26, 2013; the prior application is herewith incorporated by reference in its entirety.

BACKGROUND OF THE INVENTION

Field of the Invention

The present invention relates to a cableway system for the transport of persons or goods. Two pairs of track cables extend between two terminal stations, such as a valley station and a mountain station, along which vehicles are transportable by way of at least one traction cable. The track cables run in a curved path in the region of at least one support tower and the traction cable is guided in the region of the at least one support tower via carrying rollers.

In prior art cableway systems of this type, the track cables are supported along the route by towers, wherein said track cables can run, in the region of the towers, along curves. It is hereby possible to adapt the path of the cableway system to the topographical conditions.

The movement of the vehicles is effected by means of at least one traction cable. For this is provided, in particular, a self-contained traction cable, which in the terminal stations is guided via deflection pulleys, or headwheels, of which at least one is driven.

Over the path of the route, the at least one traction cable is guided via carrying rollers. For this are provided downwardly projecting cable carriers, which are fastened to the respectively mutually assigned track cables and on which is respectively mounted at least one carrying roller, by which the traction cable is supported. The track cable is here located roughly centrally beneath the track cables. In the regions of towers, the traction cable is likewise guided via carrying rollers, which are mounted on fixed roller carriers.

Since the traction cable is coupled to the running gear of the vehicle, this means that, in those regions in which a running gear is present, it is lifted off the carrying rollers located in this region and makes its way back onto these carrying rollers only once the running gear has distanced itself from these carrying rollers. In those regions of the route of the cableway system in which this runs in a straight line, the traction cable is lowered in the vertical direction after the running gear has distanced itself from the relevant carrying rollers, whereupon it makes its way onto the middle of these carrying rollers.

By contrast, when the track cables run in a curved path, in the regions of the curves the traction cable is by a vehicle not only lifted off the carrying rollers, but it is laterally offset from these carrying rollers, whereupon it remains laterally offset also when lowered onto these carrying rollers. Hence the traction cable does not make its way back onto the middle of the carrying rollers, whereby it does not make its way directly into the cable grooves located on these carrying rollers. As a result, in the regions of curves, transverse shifts of the traction cable occur on the carrying rollers, on the basis of which either the traction cable no longer makes its way into the grooves of the relevant carrying rollers, or the traction cable is moved on the carrying rollers toward the grooves, whereby increased wear on the carrying rollers is created.

SUMMARY OF THE INVENTION

It is accordingly an object of the invention to provide a cableway system which overcomes the above-mentioned disadvantages of the heretofore-known devices and methods of this general type and to avoid these drawbacks.

With the foregoing and other objects in view there is provided, in accordance with the invention, a cableway system for transporting persons and goods, the cableway system comprising:

two pairs of track cables extending between two terminal stations and configured to carry transport vehicles traveling between the terminal stations;

at least one traction cable configured to move the vehicles along the track cables between the terminal stations;

at least one tower supporting the track cables, wherein the track cables run in a curved path in a region of the at least one tower;

a plurality of carrying rollers disposed to guide the traction cable in the region of the at least one tower, at least some of the carrying rollers for the traction cable being disposed at the at least one tower and being adjustable in a relative position thereof in relation to the track cables.

In other words, the objects are achieved according to the invention by virtue of the fact that at least some of the carrying rollers for the at least one traction cable, which are located in the region of the at least one tower, are adjustable in terms of their position in relation to the two track cables.

As a result of the change of position of the carrying rollers in regions of curvedly running track cables, the relevant carrying rollers are laterally adjusted in the same way as the traction cable, whereby it is ensured that the traction cable, when lowered, makes its way roughly onto the middle of these carrying rollers, whereby it ends up in the grooves of the carrying rollers and thus lateral shifts of the traction cable lowered onto the carrying rollers, and resultant wear on the carrying rollers, is avoided.

Preferably, the carrying rollers are adjustable under the action of an adjusting force. The relevant carrying roller for the at least one traction cable can here be mounted on a pivot arm or the like, which is pivotable in height about an at least approximately horizontal axis under the action of an adjustment mechanism, in particular an adjusting spring. The track cables can here rest, in the region of the at least one tower, on supports, in particular supporting plates, on which the pivot arm, on which a carrying roller for the at least one traction cable is mounted, is supported such that it is pivotable in height.

In particular, supports, in particular supporting plates, can be fastened to the tower, on which supports are located support bearings for the track cables, wherein the pivot arm, with the carrying roller mounted thereon, is articulately attached to one of the two supports, and the other of the two supports is configured with stops for the pivot arm.

According to another embodiment, the two track cables rest in the region of the at least one tower on respectively a support, in particular supporting plates, which supports are mutually connected by an obliquely oriented connecting strut, and a sleeve, which is acted upon by a restoring force, in particular a compression spring, and on which a carrying roller is mounted, is displaceable on this connecting strut. A stop can here be assigned to the displaceable sleeve.

Furthermore, the two track cables can each rest in the region of the at least one tower on a respective support, in particular supporting plates, which two supports are mutually connected by a connecting strut, wherein on the connecting strut are mounted two link arms, to which is articulately attached a support for a carrying roller, wherein this support is acted upon by an adjusting force, in particular a compression spring, by which it is laterally adjustable in relation to the supports for the track cables, in particular in relation to the supporting plates.

Furthermore, one of the two supports, in particular supporting plates, can be configured with a stop.

According to a further embodiment, in the region of the at least one tower are provided supports, in particular vertical supporting plates, between which a pivot arm, on which a carrying roller is mounted, is pivotably mounted on a fixed bolt, wherein the pivot arm is adjustable under the action of an adjusting force, in particular a weight or an electric motor, into an upper pivot position.

Moreover, the pivot arm can be adjustable in height between two stops.

Other features which are considered as characteristic for the invention are set forth in the appended claims.

Although the invention is illustrated and described herein as embodied in a cableway system for the transport of persons or goods, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
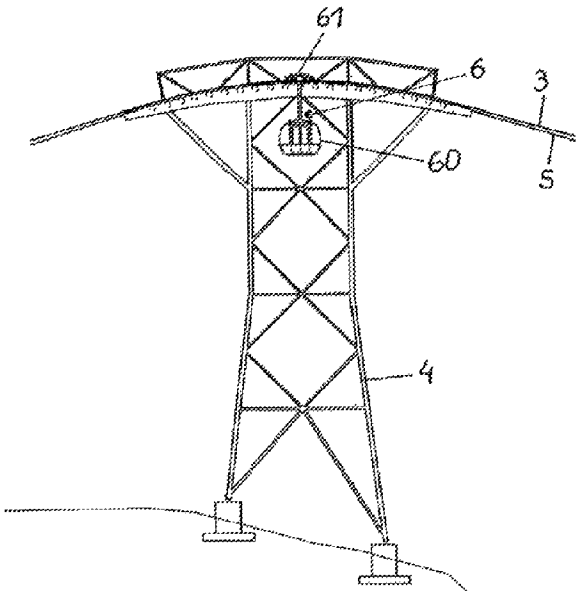
FIG. 1 is a partial side view of a cableway system according to the invention in schematic representation.
Figure 1A:
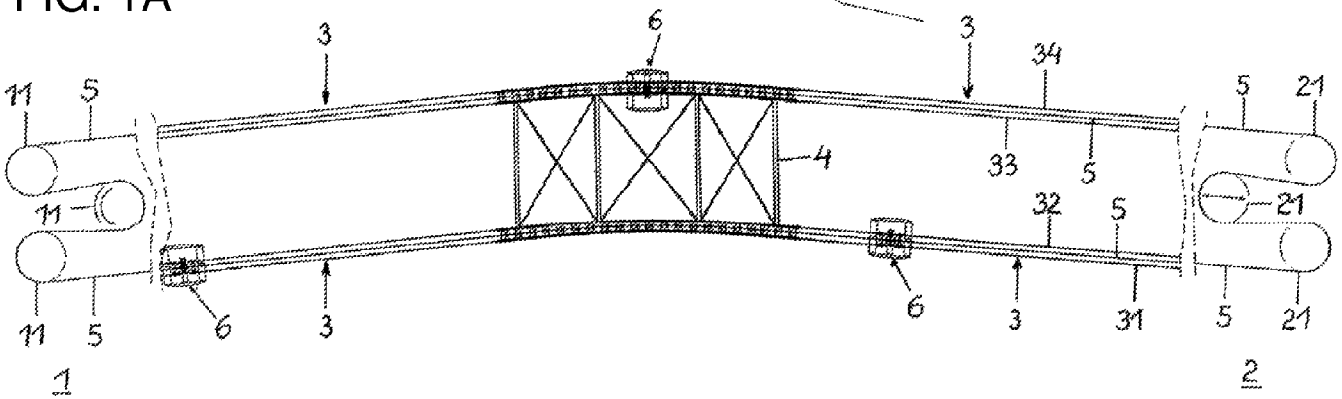
FIG. 1A is a plan view thereof.

Referring now to the figures of the drawing in detail and first, particularly, to FIGS. 1 and 1A thereof, there is shown a cableway system with a first terminal station 1 and a second terminal station 2, between which two pairs of track cables 3, namely the respectively mutually assigned track cables 31, 32 and 33, 34, extend. In the path along the route of the cableway system, the track cables 3 are guided via towers 4 or pylons and supported by these. Furthermore, in the cableway system is located a self-contained traction cable 5, which in the terminal stations 1 and 2 is guided via deflection pulleys 11, 21, or headwheels, of which at least one, for instance the wheel 11, is driven. Along the track cables 31 and 32, by means of the traction cable 5, vehicles 6 which are coupled to the latter and which are configured with a vehicle cabin 60 and with a running gear 61 are transported from the first terminal station 1 to the second terminal station 2. Along the track cables 33 and 34, the vehicles 6 coupled to the traction cable 5 are transported back into the first terminal station 1. In the two terminal stations 1 and 2 are provided guide rails, along which the vehicles 6 decoupled from the traction cable 5 are moved through the terminal stations 1 and 2 and are moved from one pair of track cables 3 onto the other pair of track cables 3, whereupon they are re coupled to the self-contained traction cable 5.

As is represented in FIG. 1A, the track cables 3 run in a curved path in the region of the tower 4. In the regions of further towers, the track cables 3 likewise run in a curved path. The path of the cableway system can hence be adapted to the topographical conditions. In the rectilinear regions of the cableway system, the two mutually assigned track cables 31, 32 are connected by cable carriers, on which carrying rollers for the traction cable 5 are mounted. In those regions of the towers 4 in which the track cables 31, 32 rest on support bearings in relation to which they are displaceable, there are likewise provided carrying rollers for the traction cable 5, which are mounted on roller carriers fastened to the mutually assigned supporting devices for the track cables 3.

Figure 2:
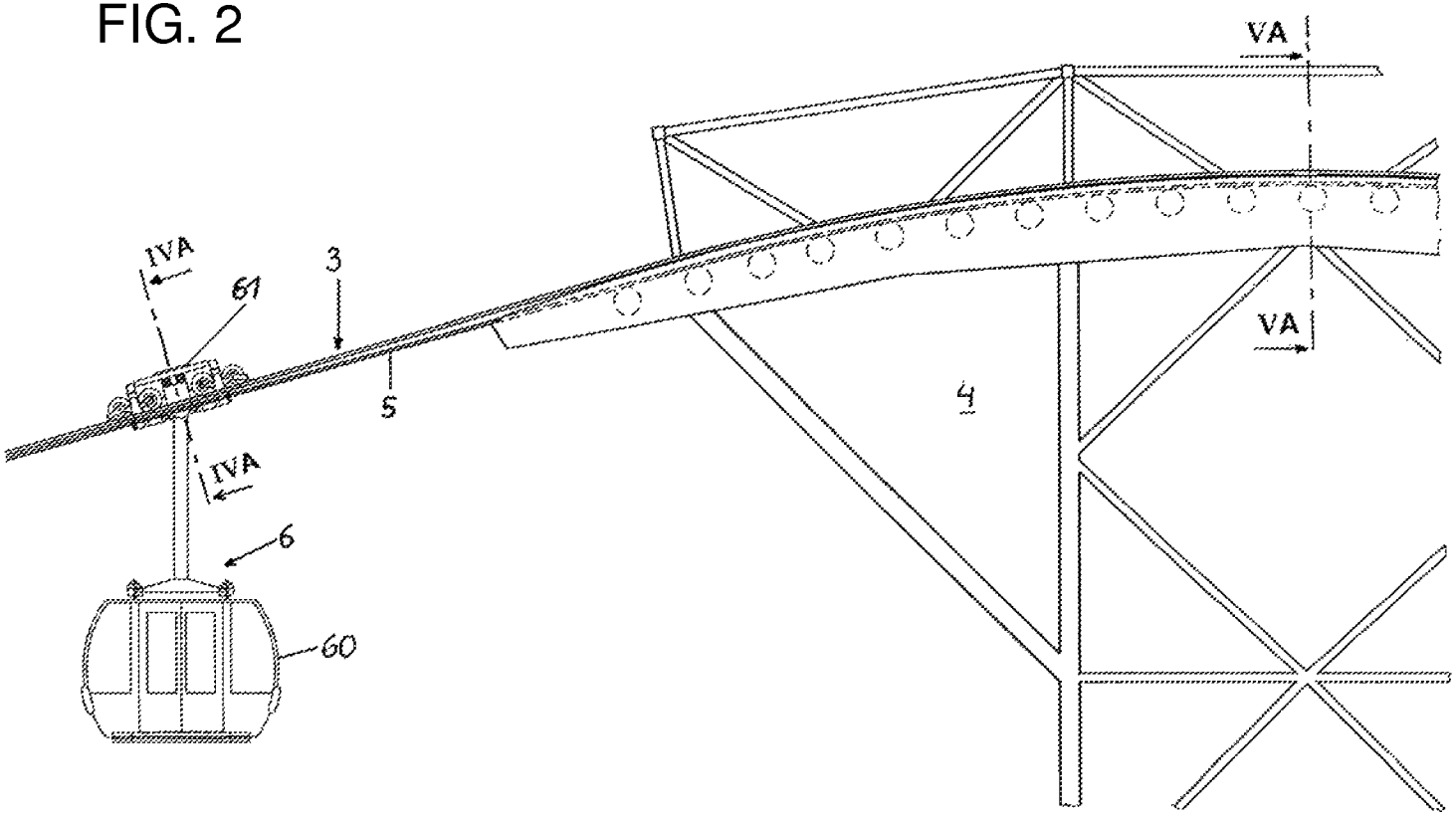
FIG. 2 is a side view of a portion of the cableway system in the region of a tower, with a vehicle located just outside the tower.

In FIG. 2, a portion of the cableway system is represented, wherein a vehicle 6, the running gear 61 of which is transported along the track cables 3 by means of the traction cable 5, is approaching a tower 4.

Figure 3A:
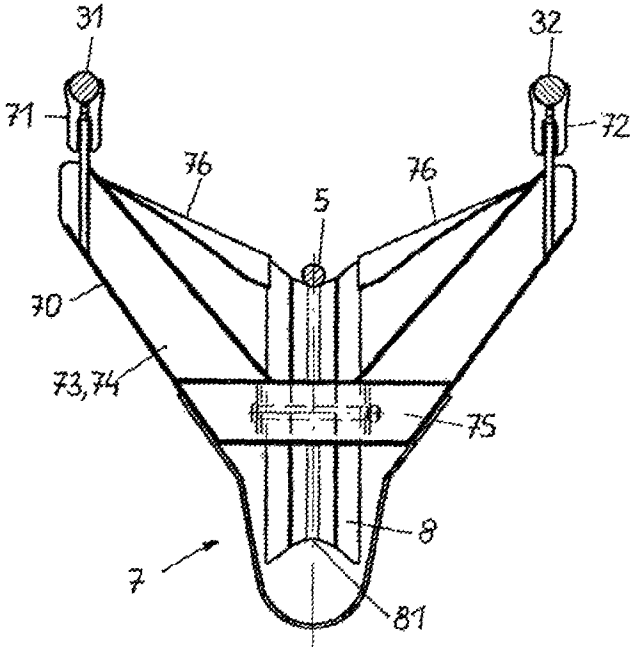
FIG. 3 is a side view and FIG. 3A is a front view of a cable carrier, which is fastened to the mutually assigned track cables and on which a carrying roller for the traction cable is mounted.
Figure 3:
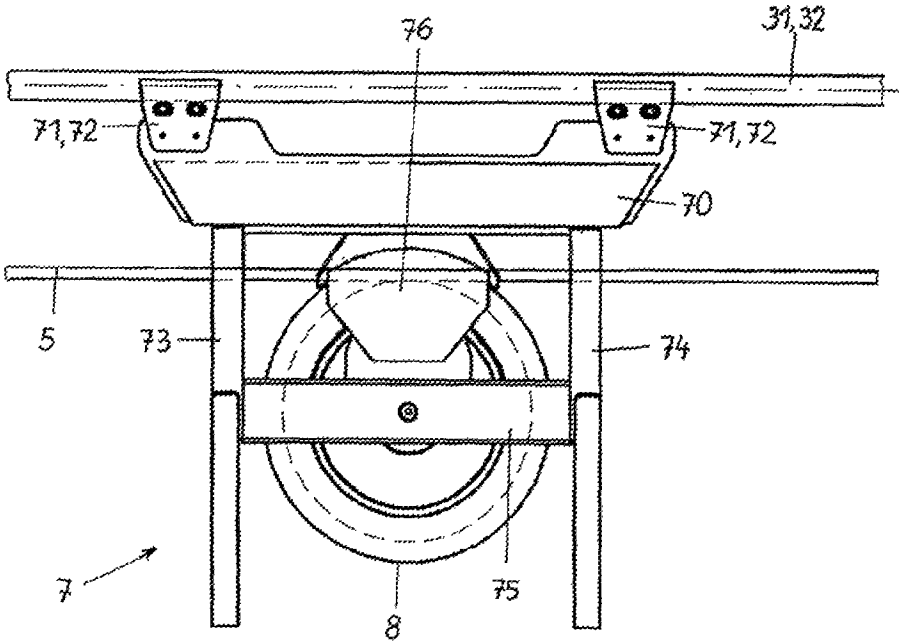

In FIG. 3 and FIG. 3A is represented a cable carrier 7 of that type which are found in the rectilinear sections of the cableway system. This cable carrier 7 consists of a supporting structure 70, which is clamped by means of two pairs of clamps 71, 72 to the track cables 31, 32. Projecting vertically downward from the supporting structure 70 are two approximately V-shaped brackets 73, 74, which are located at a distance apart in the longitudinal direction of the track cables 31, 32 and which are connected to each other by means of a supporting frame 75. On the supporting frame 75 is mounted a carrying roller 8 for the traction cable 5. Furthermore, on both sides of the carrying roller 8 are located cable position adapters 76 fastened to the supporting frame 75. Insofar as no vehicle 6 is located in the region of the cable carrier 7, the traction cable 5 is located in the running groove 81 of the carrying roller 8. In this regard, reference is made to FIG. 3A.

Figure 4A:
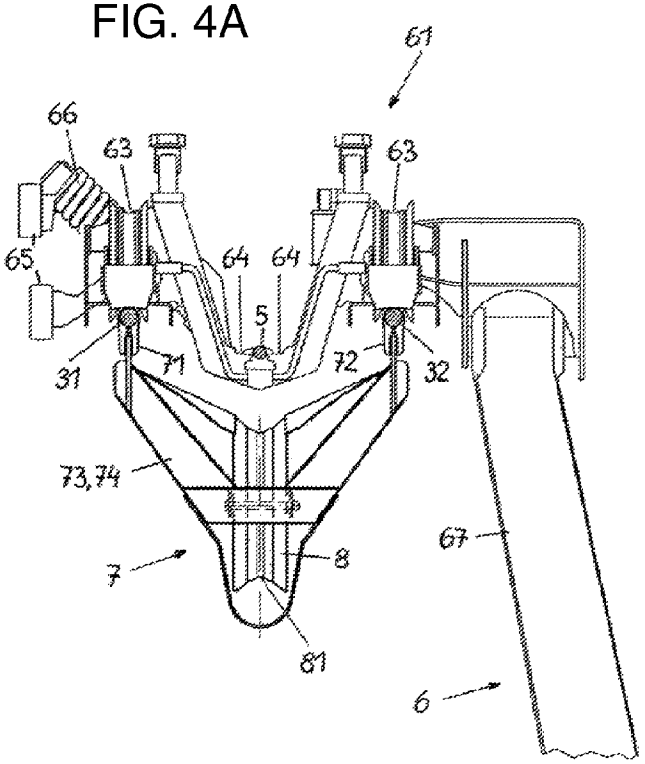
FIG. 4A is a section thereof taken along the line IVA-IVA of FIG. 2.
Figure 4:
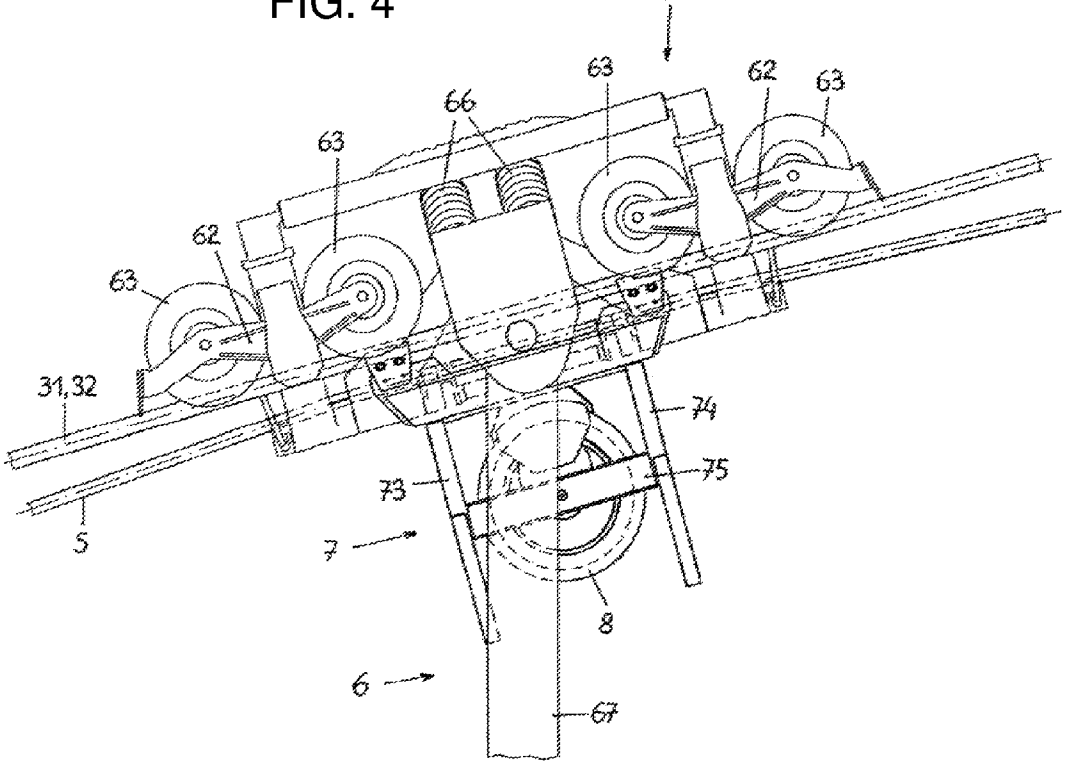
FIG. 4 is a side view of a cable carrier and a running gear of a vehicle on an enlarged scale.

In FIG. 4 and FIG. 4A, a running gear 61 of a vehicle 6 coupled to the traction cable 5 and a cable carrier 7, which is fastened to the track cable 31, 32 and which is traveled over by the running gear 61, are represented. The running gear 61 is configured with two pairs of rocker arms 62, on which respectively a pair of running wheels 63 is mounted, wherein two pairs of running wheels 63 run along the track cable 31 and the two other pairs of running wheels 63 run along the track cable 32. Furthermore, the running gear 61 of the vehicle 6 is configured with two mutually assigned clamping jaws 64, which can be actuated by means of two control rollers 65 counter to the action of compression springs 66. By means of the clamping jaws 64, the running gear 61 can be clamped to the traction cable 5.

Articulately attached to the running gear 61 is a carrying bar 67, to lower end of which the vehicle cabin 60 is fastened.

As can be seen from FIG. 4 and FIG. 4A, the traction cable 5, when the cable carrier 7 is travelled over by the running gear 61, is lifted off the carrying roller 8. As soon as the running gear 61 has distanced itself from the cable carrier 7, the traction cable 5 is lowered again, whereby it makes its way into the running groove 81 of the carrying roller 8. Since the track cables 3 run in a straight line between the towers 4, no deflection of the traction cable 5 occurs, so that this makes its way back into the running grooves 81 of the carrying rollers 8 after the running gears 61 have distanced themselves from the cable carriers 7.

Figure 5:
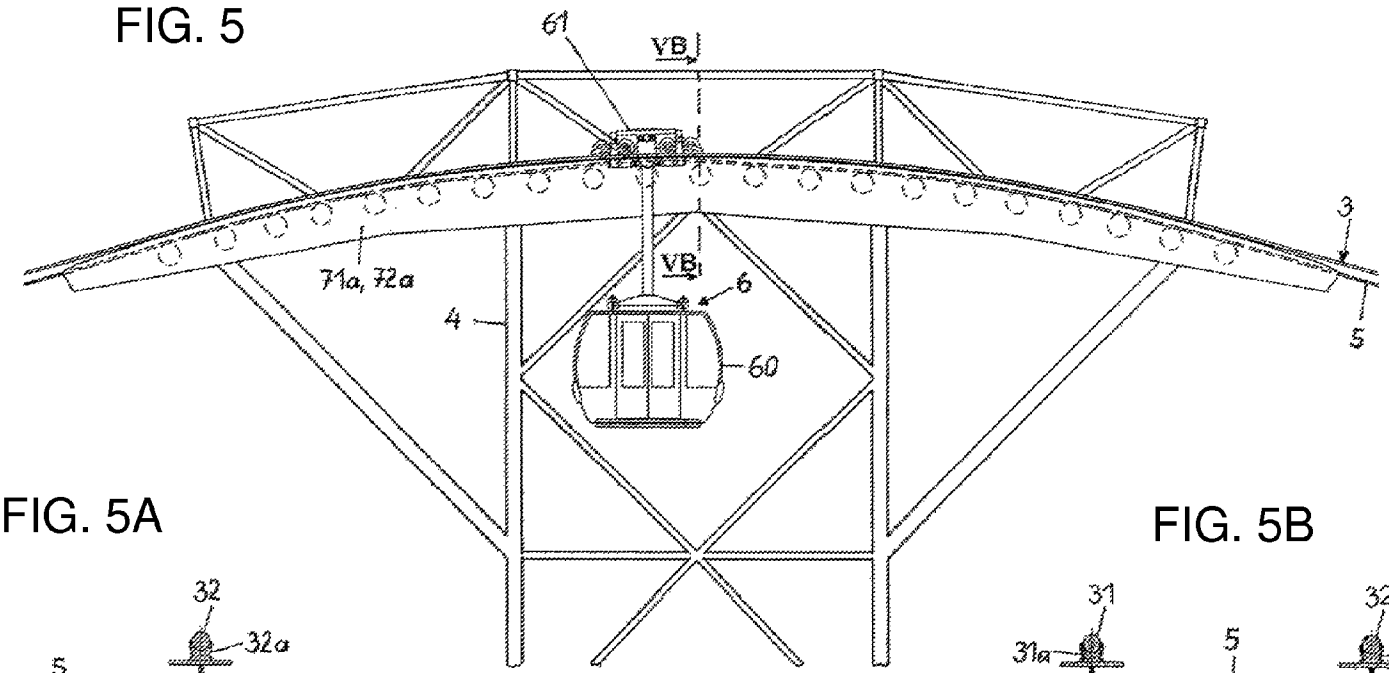
FIG. 5 is a side view of a portion of the cableway system in the region of a tower, with a vehicle located on this tower.

In FIG. 5 is represented a portion of the cableway system, wherein a vehicle 6 is located on the tower 4.

As has been stated above, the track cables 3 can have a curved path on the towers 4. When the traction cable 5 is lifted off the carrying rollers located on the towers 4, a lateral deflection of the traction cable 5 takes place, however, in relation to the track cables 3, as well as in relation to the carrying rollers, whereby, when the traction cable 5 is subsequently lowered, this does not make its way into the cable groove of the relevant carrying roller.

Figure 5B:
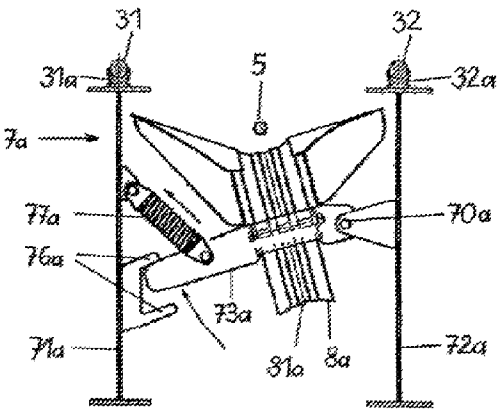
FIG. 5B is an enlarged view of a roller carrier and the traction cable in a second position of the vehicle according to FIG. 5, in section taken along the line VB-VB of FIG. 5.
Figure 5A:
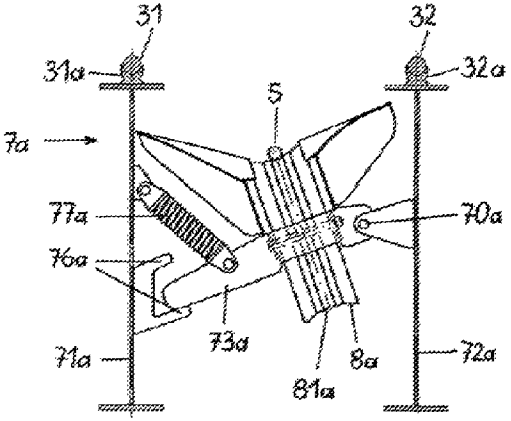
FIG. 5A is an enlarged view of a roller carrier, with a carrying roller for the traction cable, in section taken along the line VA-VA of FIG. 2.

In FIG. 5A is represented a roller carrier 7*a* of that type which is located on a tower 4 and which has the effect that, when the traction cable 5 is lowered, this makes its way directly into the cable groove of the relevant carrying roller. To the framework 4 are fastened two vertically oriented, I-shaped supporting plates 71*a*, 72*a*, on the upper ends of which are located bronze support bearings 31*a*, 32*a* for the track cables 31, 32. Between the vertical supporting plates 71*a*, 72*a* is located a pivot arm 73*a*, on which a carrying roller 8*a* for the traction cable 5 is mounted. The pivot arm 73*a* is at its one end mounted on the vertical supporting plate 72*a* such that it is pivotable in height about a bolt 70*a*. On the other vertical supporting plate 71*a* are provided two stops 76*a*, by which the vertical pivotability of the pivot arm 73*a* is limited. Furthermore, to the vertical supporting plate 71*a* and to the pivot arm 73*a* is articulately attached a tension spring 77*a*, by which the pivot arm 73*a* is loaded such that it is pivoted upward.

Along the route, the traction cable 5 rests on the carrying roller 8*a* mounted on the pivot arm 73*a*, wherein it is located in the running groove 81*a*. As long as the traction cable 5, since the running gear 61 of the vehicle 6 is not located in the region of one of the roller carriers 7*a*, has not been lifted off the carrying roller 8*a*, the tension spring 77*a*, due to the load applied by the traction cable 5, does not take effect. As soon as the running gear 61 approaches a roller carrier 7*a*, however, the traction cable 5 is lifted off the carrying roller 8*a*.

Below, the positions of the traction cable 5 given different positions of the vehicle 6 in relation to one of the carrying rollers 8*a* mounted on the tower 4 are described in the case of a curved path of the track cables 3, as is represented in FIG. 1A.

According to FIG. 2, the vehicle 6 is located at such a distance from those carrying rollers 8*a* which are mounted on the tower 4 that the traction cable 5 is not yet lifted off these carrying rollers 8*a*. This position can be seen from FIG. 5A.

According to FIG. 5, the running gear 61 of the vehicle 6 is located on the tower 4 in the region of a carrying roller 8*a*. As can be seen from FIG. 5B, the traction cable 5 is here lifted off the carrying roller 8*a*, whereby the pivot arm 73*a*, under the action of the tension spring 76*a*, has been shifted into its upper pivot position.

Figure 6:
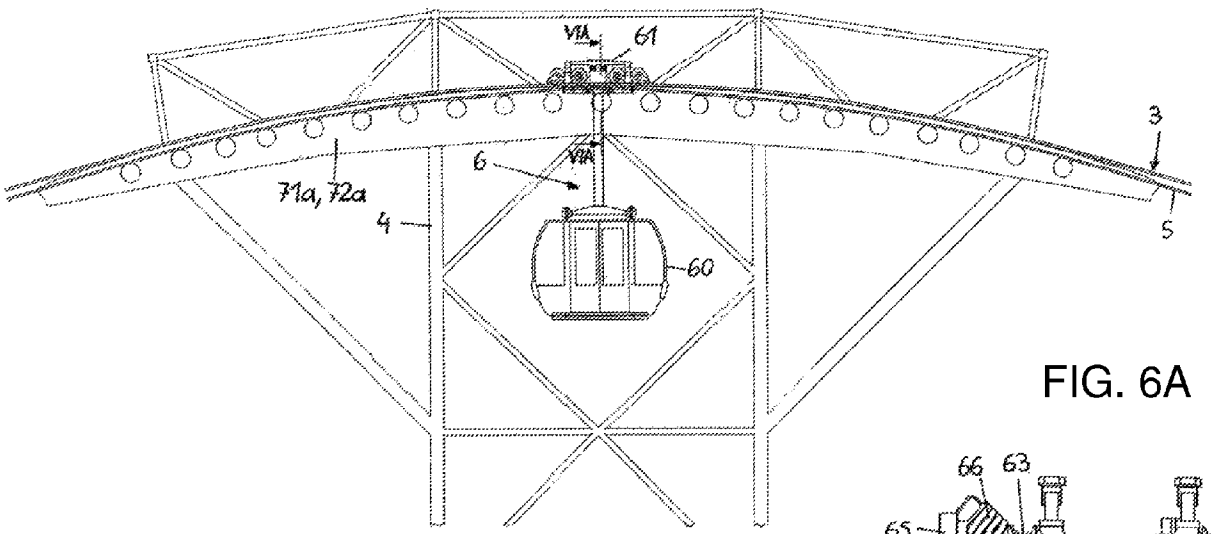
FIG. 6 is a side view of a portion of the cableway system in a third position of the vehicle, wherein the running gear is located above a roller carrier.
Figure 6A:
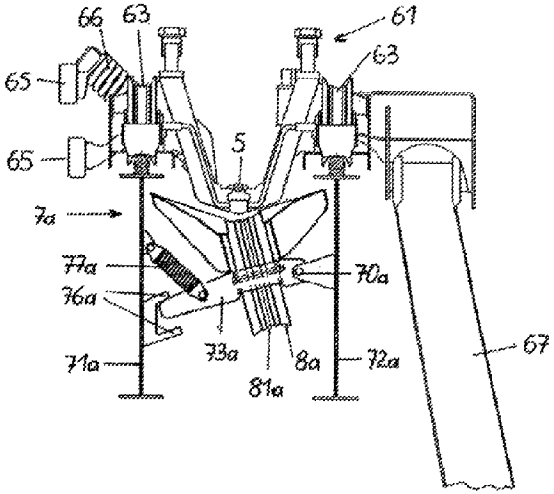
FIG. 6A shows the roller carrier, the running gear of the vehicle and the position of the traction cable, in section taken along the line VIA-VIA of FIG. 6.
Figure 7:
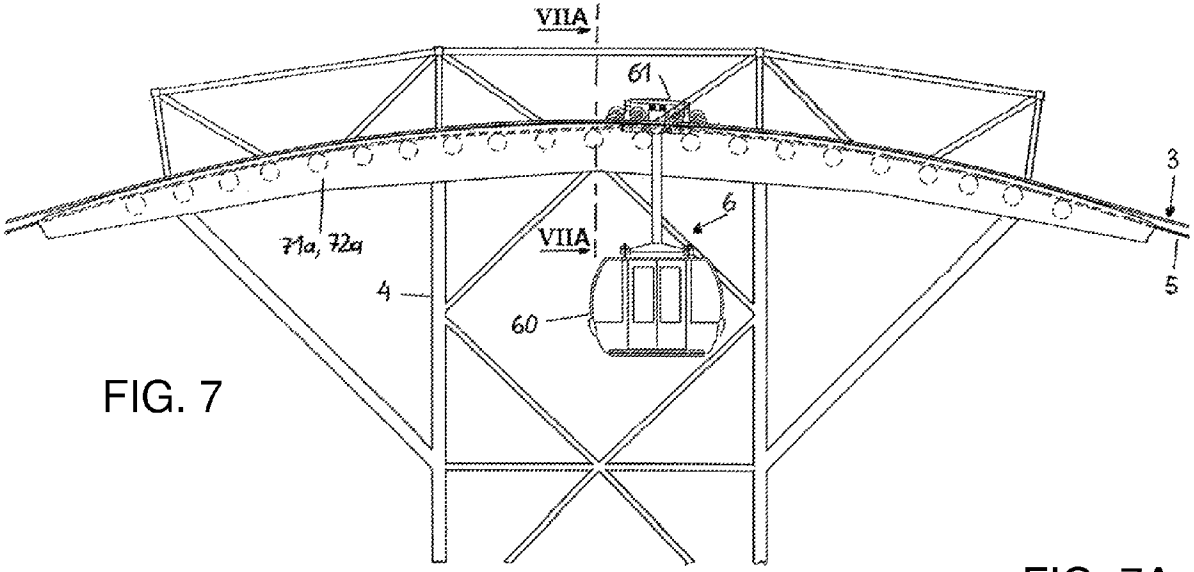
FIG. 7 is a side view of the portion of the cableway system in a fourth position of the vehicle, wherein its running gear thereof is located in the region of a roller carrier after it has traveled over the latter.
Figure 7A:
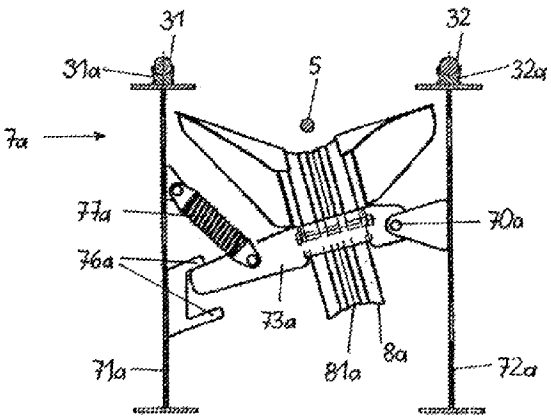
FIG. 7A shows the roller carrier and the traction cable, in section taken along the line VIIA-VIIA of FIG. 7.

As can be seen from FIG. 6 and FIG. 6A, as well as from FIG. 7 and FIG. 7A, this also applies when the running gear 61 of the vehicle 6 is located above the roller carrier 7*a* and when the running gear 61 has traveled over the roller carrier 7*a*, yet the running gear 61 is still in the region of this roller carrier 7*a*.

Since the track cables 31, 32, in the region of the tower 4, run in a curve, this means that the traction cable 5 is deflected in the direction of the center point of the curve, namely that it is laterally shifted in relation to the track cables 3 and in relation to the associated carrying roller 8*a*. As a result of the traction cable 5 being lifted off the carrying roller 8, the pivot arm 73*a*, and with this the carrying roller 8*a*, under the action of the tension spring 77*a*, are adjusted such that that region of the carrying roller 8*a* which is facing the traction cable 5 is likewise adjusted in the direction of the center point of the curve, whereby the running groove 81*a* of the carrying roller 8*a* is located approximately beneath the traction cable 5.

Figure 8:
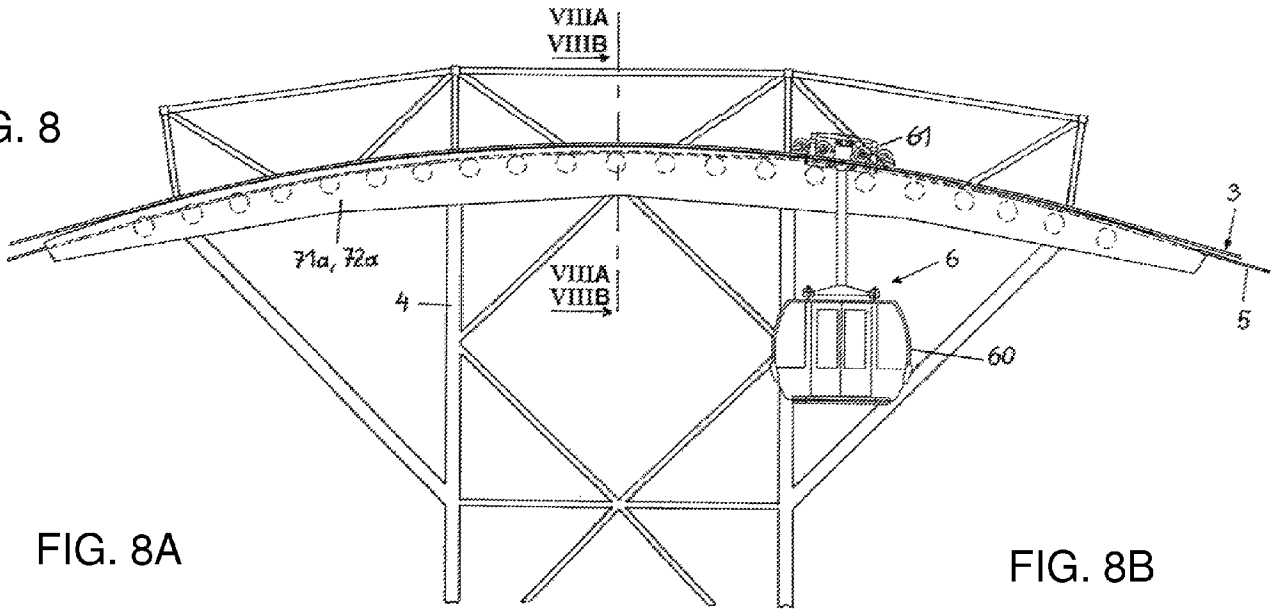
FIG. 8 is a side view of a portion of the cableway system in a fifth position of the vehicle, the running gear of which is located outside the region of a roller carrier.
Figure 8B:
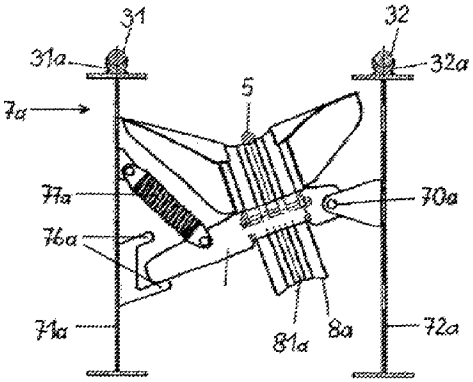
FIGS. 8A and 8B show a first embodiment of the roller carrier and the position of the traction cable, in sections along the line VIIIA-VIIIA and VIIIB-VIIIB of FIG. 8.
Figure 8A:
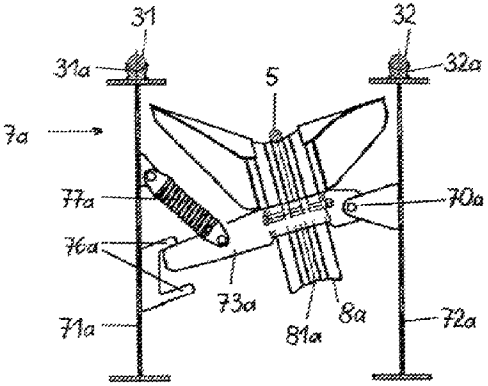

In FIG. 8A, a portion of the cableway system is represented, wherein the vehicle 6 has distanced itself from the carrying roller 8*a* to such an extent that the traction cable 5 is lowered back onto the carrying roller 8*a*. The traction cable 5, even though, because of the curved path of the track cables 3, it has been laterally deflected in relation to these, hence makes its way directly into the running roller 81*a* of the carrying roller 8*a*. Subsequently, the pivot arm 73*a*, because of its loading by the traction cable 5, is adjusted counter to the action of the tension spring 77*a* out of the upper pivot position back into the lower pivot position, as is represented in FIG. 8B.

The pivotability of the carrying rollers 8*a* for the traction cable 5 in regions of a curved path of the track cables 3 thus means that, with respect to the lateral deflection of the traction cable 5, the position of the carrying rollers 8*a* is adapted to the position of the traction cable 5, whereby it is ensured that the traction cable 5, when lowered, makes its way directly into the running grooves 81*a*. As a result, shearing motions of the traction cable 5 in relation to the carrying rollers 8*a*, and thereby increased wear on the carrying rollers 8*a*, are avoided.

Figure 9A:
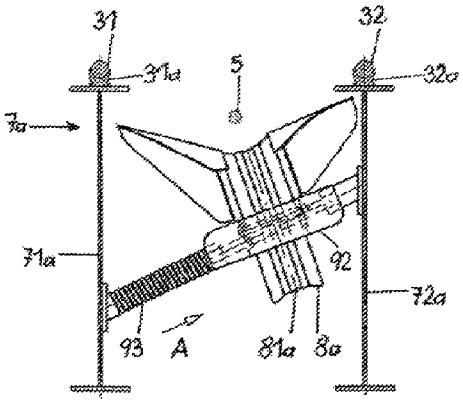
FIGS. 9 and 9A show a second embodiment of a roller carrier according to the invention, in two positions and in front view.
Figure 9:
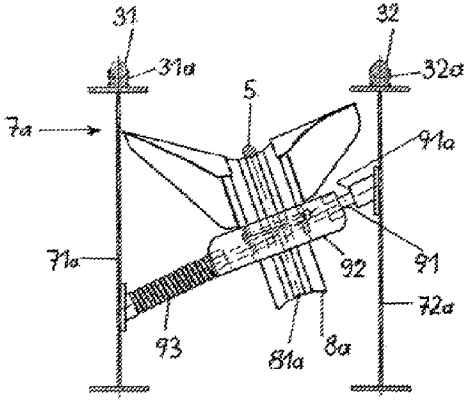

In FIG. 9 and FIG. 9A, a second embodiment of a roller carrier 7*a* according to the invention, with a carrying roller 8*a* which is laterally and vertically adjustable in relation to the track cables 31*a*, 32*a*, is represented. The two vertical supporting plates 71*a* and 72*a* are here mutually connected by an obliquely oriented strut 91 which is fastened to these, wherein on this strut 91 is a sleeve 92, which, under the action of a compression spring 93, is displaceable in the direction of the arrow A, and on which the carrying roller 8 is mounted. To the sleeve 91 is assigned a stop 91*a*.

As long as the traction cable 5 is guided in the running groove 81*a*, as can be seen from FIG. 9, the compression spring 93 is in its tensioned position. As soon as the traction cable 5, since the carrying roller 8*a* is traveled over by a running gear 61, is raised, the sleeve 92, under the action of the compression spring 93, is displaced in the direction of the arrow A, as can be seen from FIG. 9A. The carrying roller 8*a* is hereby adjusted in accordance with the lateral deflection of the traction cable 5. As soon as the traction cable 5 is lowered, it makes its way directly into the running groove 81*a*. Subsequently, the sleeve 92, due to the load exerted by the traction cable 5, is shifted back counter to the direction of the arrow A, whereby the compression spring 93 is once again tensioned.

Figure 10A:
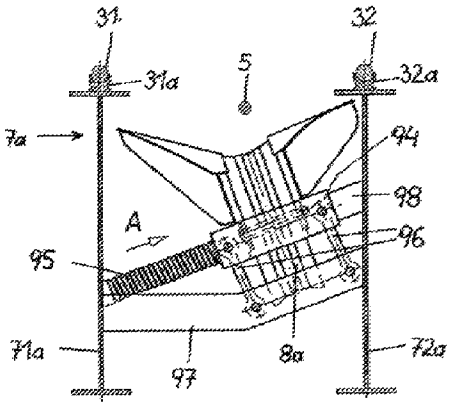
FIGS. 10 and 10A show a third embodiment of a roller carrier according to the invention, in two positions and in front view.
Figure 10:
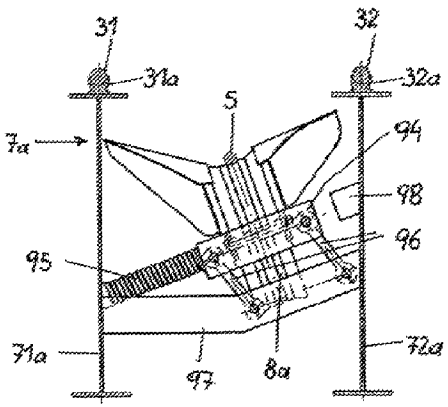

In FIG. 10 and FIG. 10A, a third embodiment of a roller carrier 7*a* according to the invention is represented. To the two vertical supporting plates 71*a*, 72*a* is here fastened a strut 97, to which two link arms 96 are articulately attached. Supported by the two link arms 96 is a carrier 94, on which the carrying roller 8*a* is mounted and which is acted upon by a compression spring 95. Furthermore, on the vertical supporting plate 72*a* is provided a stop 98, against which the carrier 94, upon its lateral adjustment, comes to bear, whereby its adjusting motion is limited.

Figure 11A:
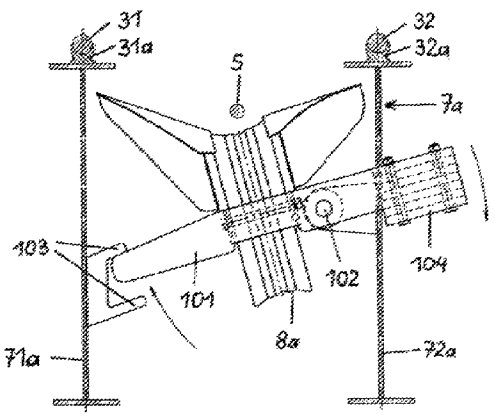
FIGS. 11 and 11A show a fourth embodiment of a roller carrier according to the invention, in two positions and inside view.
Figure 11:
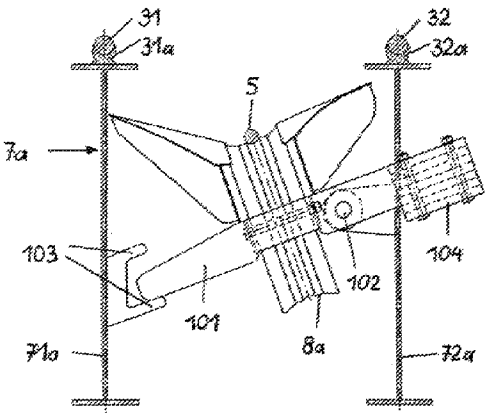

In FIG. 11 and FIG. 11A, a fourth embodiment of a roller carrier 7*a* according to the invention is represented. The carrying roller 8*a* is here mounted on a pivot arm 101, which is mounted on a fixed bolt 102. To one of the two ends of the pivot arm 101, stops 103 are assigned. At its other end, a weight 104 is fastened to the pivot arm 101.

As long as the traction cable 5 is located on the carrying roller 8*a*, the pivot arm 101 is located, counter to the action of the weight 104, in its lower pivot position, which is represented in FIG. 11A.

As soon as the traction cable 5 is lifted off the carrying roller 8*a*, the pivot arm 101, under the action of the weight 104, is shifted into its upper pivot position, whereby the carrying roller 8*a* is raised somewhat and laterally offset, as is represented in FIG. 11A.

Figure 12A:
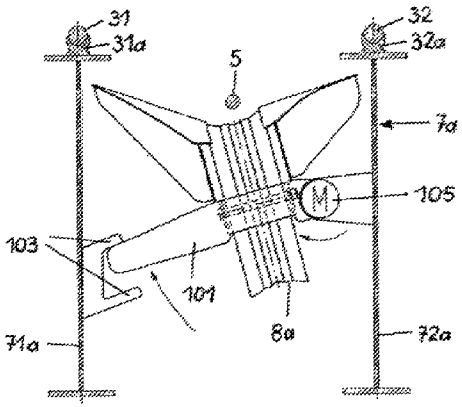
FIGS. 12 and 12A show a fifth embodiment of a roller carrier according to the invention, in two positions and inside view.
Figure 12:
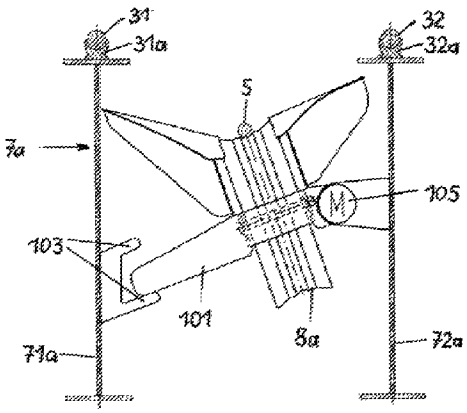

In FIG. 12 and FIG. 12A is represented a fifth embodiment of a roller carrier 7*a*, which differs from the fourth embodiment according to FIG. 11 and FIG. 11A by virtue of the fact that the adjusting force for the adjustment of the pivot arm 101 is applied not by a weight, but rather by an electric motor 105.

The working method of the adjustability of the carrying roller 8*a*, in the embodiments of the roller carrier according to FIG. 10 and FIG. 10A, FIG. 11 and FIG. 11A or FIG. 12 and FIG. 12A, corresponds to that working method which is described above with reference to the illustrative embodiment according to FIG. 9 and FIG. 9A.

The invention claimed is:

1. A cableway system for transporting persons and goods, the cableway system comprising:

two pairs of track cables extending between two terminal stations and configured to carry transport vehicles traveling between the terminal stations;

at least one traction cable configured to move the vehicles along said track cables between said terminal stations;

at least one tower supporting said track cables, wherein said track cables run in a curved path as seen in a plan view in a region of said at least one tower;

a plurality of carrying rollers disposed to guide said traction cable in the region of said at least one tower, at least some of said carrying rollers for said traction cable being mounted to said at least one tower for adjustment in a relative position thereof in relation to said track cables in a vertical direction and a lateral direction.

2. The cableway system according to claim 1, wherein said carrying rollers are adjustable under an action of an adjusting force.

3. The cableway system according to claim 1, wherein the respective said carrying roller for supporting said traction cable is mounted on a pivot arm that is pivotable in height about a substantially horizontal axis under the action of an adjustment mechanism.

4. The cableway system according to claim 3, wherein the adjustment mechanism is an adjusting spring.

5. The cableway system according to claim 3, wherein said track cables rest, in the region of the at least one tower, on supports, and said pivot arm, on which a carrying roller for the at least one traction cable is mounted, is supported pivotally in height.

6. The cableway system according to claim 5, wherein said supports are supporting plates.

7. The cableway system according to claim 5, which comprises supporting plates mounted to said tower and carrying support bearings for said track cables, wherein said pivot arm, with said carrying roller mounted thereon, is articulated to one of said two supports, and the other of said two supports is configured with stops for said pivot arm.

8. The cableway system according to claim 5, which comprises two stops between which said pivot arm is adjustable in height.

9. The cableway system according to claim 1, wherein each of said two track cables rests in the region of said at least one tower on a respective support, and said supports are connected to one another by an obliquely oriented connecting strut, and wherein a sleeve, which is acted upon by a restoring force, and on which a carrying roller is mounted, is displaceable on said connecting strut.

10. The cableway system according to claim 9, wherein said supports are supporting plates and said restoring force is provided by a compression spring.

11. The cableway system according to claim 9, which comprises a stop assigned to said displaceable sleeve.

12. The cableway system according to claim 1, wherein each of said two track cables rests in the region of said at least one tower on a respective support, and said two supports are connected to one another by a connecting strut, and two link arms are mounted on said connecting strut with a support for a carrying roller articulated thereon, wherein said support is acted upon by an adjusting force, by which said support is laterally adjustable in relation to said supports for said track cables.

13. The cableway system according to claim 12, wherein said supports for said track cables are supporting plates, and said adjusting force is provided by a compression spring for laterally adjusting said support in relation to said supports for said track cables in relation to said supporting plates.

14. The cableway system according to claim 13, wherein one of said two supporting plates is configured with a stop.

15. The cableway system according to claim 1, which comprises supports disposed in the region of said at least one tower and a pivot arm mounted therebetween and having a carrying roller mounted thereon, said pivot arm being pivotally mounted on a fixed bolt and said pivot arm being adjustable under the action of an adjusting force into an upper pivot position.

16. The cableway system according to claim 15, wherein said supports are vertical supporting plates, and said adjusting force is provided by a weight or an electric motor.

17. The cableway system according to claim 16, which comprises two stops between which said pivot arm is adjustable in height.

* * * * *